United States Patent [19]

Tsutsumi

[11] Patent Number: 4,924,669

[45] Date of Patent: May 15, 1990

[54] COVER STRUCTURE FOR EXHAUST MANIFOLD INLET DUCTS

[75] Inventor: Masanori Tsutsumi, Hamamatsu, Japan

[73] Assignee: Suzuki Jidosha Kogyo Kabushiki Kaisha, Japan

[21] Appl. No.: 354,715

[22] Filed: May 22, 1989

[30] Foreign Application Priority Data

May 24, 1988 [JP] Japan ..... 63-68149[U]

[51] Int. Cl.[5] ..... F01N 7/10

[52] U.S. Cl. ..... 60/323

[58] Field of Search ..... 60/299, 322, 323

[56] References Cited

U.S. PATENT DOCUMENTS 4,612,767 9/1986 Engguist ..... 60/323
4,836,160 6/1989 Valev ..... 60/323

FOREIGN PATENT DOCUMENTS 2037135 9/1971 Fed. Rep. of Germany ..... 60/323
24356 2/1979 Japan ..... 60/323
244806 10/1969 U.S.S.R. ..... 60/323

*Primary Examiner*—Douglas Hart
*Attorney, Agent, or Firm*—Frank P. Presta

[57] ABSTRACT

There is disclosed a cover unit of an exhaust manifold device in which sound-and-heat shielding covers are attached via bosses to upper and lower parts of exhaust manifold inlet ducts integral with flanges secured to a cylinder head. The cover unit has such a structure that when securing the flanges to the cylinder head, a portion, of a lower cover, on which a tool inserted to rotate bolts for fastening the flanges impinges undergoes a predetermined amount of deformation to admit insertion of the tool.

3 Claims, 3 Drawing Sheets

COVER STRUCTURE FOR EXHAUST MANIFOLD INLET DUCTS

BACKGROUND OF THE INVENTION

1. Field of the Invention

The present invention relates to a cover structure for exhaust manifold inlet ducts of an engine for a vehicle.

2. Description of the Prior Art

Generation of superheat as well as of a large sound can be seen typically in an exhaust manifold unit in an engine mounted on a vehicle when actuating the engine. In great majority of cases, a cover unit is installed around the manifold for the purpose of shielding both the sound and the heat. There is illustrated one example of such installation in FIG. 5 in association with the prior art. FIG. 5 is a schematic view in side elevation. A plurality of exhaust manifold inlet ducts are laterally aligned along the side part of a cylinder head 6; and the proximal parts thereof are formed integrally with flanges 4. Flanges 4 are fixed to cylinder head 6 by fixing means such as bolts or the like, thus securing the manifold inlet ducts thereto. The foregoing sound-and-heat shielding cover unit is, as in the prior art depicted in FIG. 5, composed of an upper cover 2 and a lower cover 3 which are fixed to a boss provided on a manifold face. In some of other conventional examples, the cover unit is secured to the cylinder head. According to the present invention, however, the construction is based on such a premise that the cover unit is, as depicted in FIG. 5, fitted to the manifold itself.

Based on the structure of the prior art described above, covers 2 and 3 may be installed before or after mounting manifold 1 to cylinder head 6. With a view to obtaining good workability, however, the installation thereof is effected preferably by fastening flange 4 to cylinder head 6 with the bolt generally after fitting covers 2 and 3 to exhaust manifold 1.

FIG. 6 is a view showing in detail a part A of FIG. 5. FIG. 7 is a sectional view taken substantially along the line I—I of FIG. 6. As illustrated in FIGS. 6 and 7, however, where lower cover 3 is, as in the conventional example, fitted to exhaust manifold 1, a spacing between a face 7 of manifold 1 and lower cover 3 has to be restrictively set to, e.g., a in terms of obtaining the sound-and-heat shielding effects. A bolt 5 position in which flange 4 is attached to cylinder head 6 is in itself limitative in terms of installing strength and minimum expansion of flange 4. Consequently, as will be seen in FIG. 7, lower cover 3 tends to, as is often the case, be superposed on bolt 5 when observing flange 4 from the manifold tube; or alternatively, lower cover 3 is disposed in close proximity to bolt 5.

A problem incidental to such an arrangement is that a tool for turning bolt 5 can not be inserted when fitting flange 4 to cylinder head 6 after previously mounting lower cover 3 on exhaust manifold 1. When upper cover 2 is, as shown in FIG. 5, attached beforehand to manifold 1, the tool is never inserted and therefore the fixation can not be effected, unless the bolt of flange 4 is positioned outwardly of upper cover 2. This arrangement does not fall within the scope of the invention.

Lower case 3 is in some cases attached to the underside of manifold 1. After securing manifold 1 to cylinder head 6, the installation thereof entails some difficulty. This is disadvantageous in terms of a working efficiency.

Accordingly, in an exhaust manifold cover unit arranged such that a cover unit for shielding both a sound and heat is attached to a boss provided on an outer periphery of an exhaust manifold of such a type that a flange provided at the proximal part thereof is fastened to a cylinder head with a bolt, it is a primary object of the present invention to provide a cover structure characterized in that a bolt fastening tool can be inserted by causing deformation in a portion on which the cover unit projects in a direction of its tabular width with respect to a bolt for fixing the flange or in the vicinity thereof.

SUMMARY OF THE INVENTION

To accomplish the foregoing object, according to one aspect of the invention, in an exhaust manifold device comprising: a plurality of exhaust manifold inlet ducts each bent downwards; a cylinder head perforated with exhaust holes; flanges integrally in common formed to adjust themselves to the exhaust holes and attached to the side part of the cylinder head; and sound-and-heat shielding covers fixed to upper and lower parts of the series of exhaust manifold inlet ducts by use of bosses provided on outer peripheries of the exhaust manifold inlet ducts in accordance with curvatures of the exhaust manifold inlet ducts, there is provided a cover structure, characterized in that a bent part admitting insertion of a tool for turning the bolt in the axial direction of the bolt is formed in a portion, of the lower cover, on which the lower cover projects in a direction of its tabular width with respect to the bolt of the flange and/or in the vicinity of the bolt.

BRIEF DESCRIPTION OF THE DRAWINGS

Other objects and advantages of the invention will become apparent during the following discussion in conjunction with the accompanying drawings, in which:

FIG. 1 is a side view of the principal portion, illustrating one embodiment of the present invention;

FIG. 2 is a sectional view taken substantially along the line II—II of FIG. 1;

FIG. 3 is a sectional view, corresponding to FIG. 2, illustrating another embodiment of the present invention;

FIG. 4 is a sectional view, corresponding to FIG. 2, illustrating still another embodiment of the present invention;

FIG. 5 is a schematic view in side elevation, depicting a conventional exhaust manifold fitted with upper and lower covers;

FIG. 6 is a view fully showing a part A of FIG. 5; and

FIG. 7 is a sectional view taken substantially along the line I—I of FIG. 6.

DETAILED EXPLANATION OF THE PREFERRED EMBODIMENTS

Figure 3:
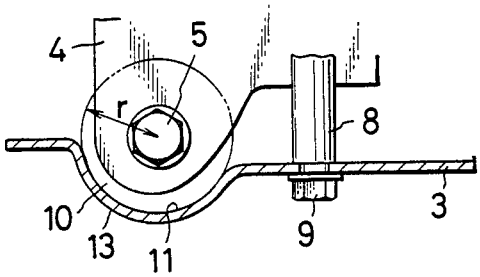
Figure 4:
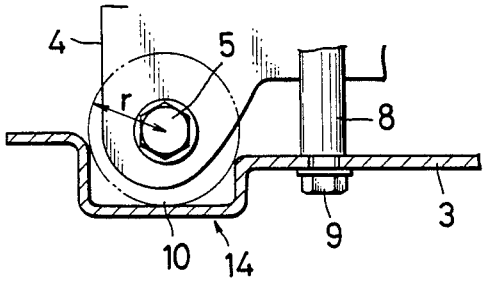
Figure 5:
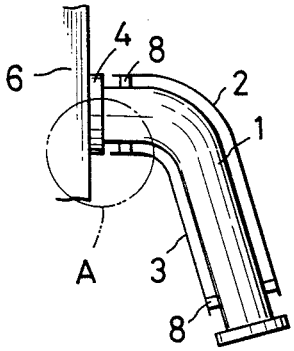
FIG. 5 Prior Art
FIGS. 5 to 7 show an example of the prior art.
Figure 6:
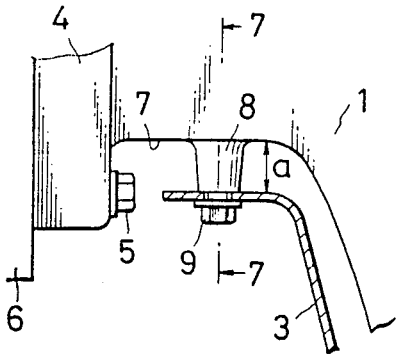
FIG.6 Prior Art
Figure 7:
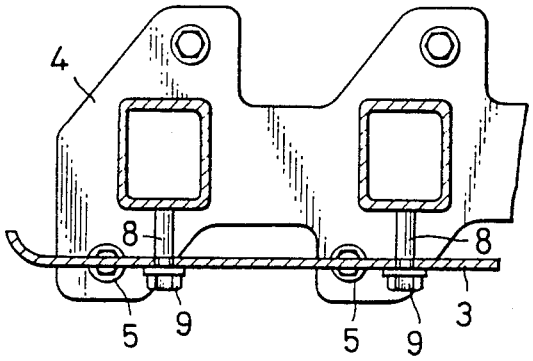
FIG.7 Prior Art

The illustrative embodiments of the present invention will hereinafter be described in detail with reference to FIGS. 1 through 4. Note that the same components as those shown in the prior art of FIGS. 5 to 7 are marked with the like symbols.

Figure 1:
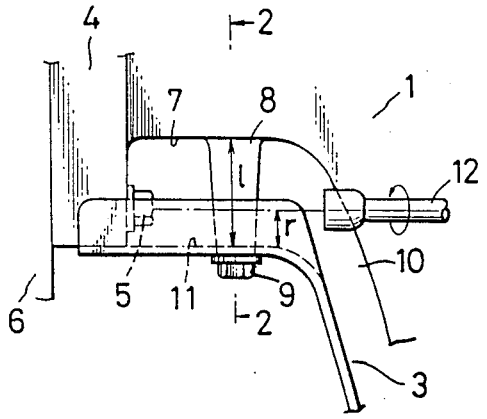
FIGS. 1 to 4 in combination show illustrative embodiments of the present invention.
Figure 2:
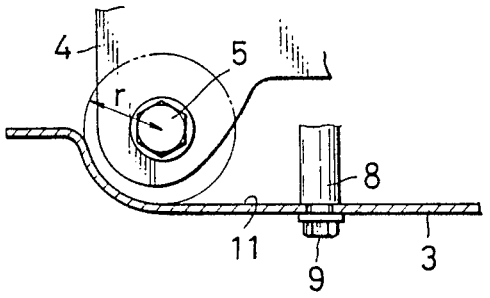

The description will now deal with a first embodiment of the present invention in conjunction with FIGS. 1 and 2.

Bosses 8 each having a predetermined length 1 are protruded downwardly of tube faces 7 of a plurality of exhaust manifold inlet ducts 1. Fixed to each boss 8 is a cover unit 3 intended to shield both sound and heat by use of a bolt 9. Provided at the proximal part of exhaust manifold inlet duct 1 is a flange 4 which is in turn fixed to a cylinder head 6 with a bolt 5. Cover unit 3 extends in plane over the entire region in such a direction that the plurality of exhaust manifold inlet ducts 1 are laterally arranged. Cover unit 3 is also disposed to cover the lower part of each tube face 7 of exhaust manifold inlet ducts 1 with a given clearance. This clearance is determined by length 1 of boss 8 of exhaust manifold inlet duct 1. On the occasion of setting length 1, the following arrangement has to be taken into consideration. Namely, when securing bolt 5 to flange 4, it is required that a working space 10 having the least radius r be secured to extend in the axial direction. Cover unit 3 is adapted to steer clear of working space 10, thereby admitting the insertion of the tool. Note that radius r is obtained by adding a working allowance to an outer peripheral radius of tool 12. Cover unit 3 is, when being bolt-fixed to exhaust manifold inlet ducts 1, shaped to extend its top end towards flange 4, wrapping in the lower face of flange 4 of exhaust manifold inlet duct 1 and further the side face thereof.

Based on this construction, the attachment of the exhaust manifold inlet duct to the cylinder head involves the steps of previously fixing a lower cover of cover unit 3 to boss 8 of exhaust manifold inlet duct 1 with bolt 9, and subsequently fixing exhaust manifold inlet duct 1 standing as it is to cylinder head 6 with a bolt. On the occasion of the bolt-fixation of exhaust manifold inlet duct 1, a position of flange 4 of exhaust manifold inlet duct 1 is at first set to cylinder head 6, in which state tool 12 is, as depicted in FIG. 1, inserted in working space 10, and bolt 5 is rotated. As a result, exhaust manifold inlet duct 1 is fixedly fastened to cylinder head 6 while it remains fitted with cover unit 3. In general, the fastening of bolt 5 by use of tool 12 tends to cause a dropout of bolt 5. In accordance with this embodiment, however, the top part of cover unit 3 extending to cover flange 4 performs a function as a receptor for preventing bolt 5 from coming off.

A second embodiment of the present invention will hereinafter be explained. Referring to FIG. 3, boss 8 of exhaust manifold inlet duct 1 is, as in the preceding case, shaped short. Formed in cover unit 3 is a recess 13 assuming a semi-cylindrical configuration having a radius r in the axial direction of bolt 5. In the second embodiment, working space 10 having radius r is surely formed in recess 13.

The description will then be focused on a third embodiment. Turning to FIG. 4, boss 8 of exhaust manifold inlet duct 1 is short, and a protrusion 14 is formed on only a cover unit 3 portion corresponding to boss 8.

Although the illustrative embodiments of the invention have been described in detail with reference to the accompanying drawings, it is to be understood that the invention is not limited to those precise embodiments. Various changes or modifications may be effected therein by one skilled in the art without departing from the scope or spirit of the invention.

What is claimed is:

1. In an exhaust manifold device comprising:

a plurality of exhaust manifold inlet ducts each bent downwards;

a cylinder head perforated with exhaust ports;

flanges integrally formed on said inlet ducts to adjust themselves to said exhaust ports and fixed to said cylinder head with bolts; and sound-and-heat shielding covers fixed to upper and lower parts of said exhaust manifold inlet ducts in accordance with curvatures of said exhaust manifold inlet ducts, each cover for said exhaust manifold inlet ducts being characterized in that a bent part for enabling insertion of a tool for turning said bolt in the axial direction of said bolt is formed in a lower portion of said cover, on which said lower cover portion projects in a direction of its tabular width with respect to said bolt of said flange.

2. The cover structure as set forth in claim 1, wherein said bent part is coaxial with said bolt.

3. The cover structure as set forth in claim 1, wherein said bent part is formed as a U-shaped recess.

* * * * *